US007160391B2

(12) United States Patent
Willey et al.

(10) Patent No.: US 7,160,391 B2
(45) Date of Patent: Jan. 9, 2007

(54) ELECTROSTATIC NOZZLE APPARATUS

(75) Inventors: Alan David Willey, Cincinnati, OH (US); Vladimir Gartstein, Cincinnati, OH (US); Chinto Benjamin Gaw, Cincinnati, OH (US); Jean Angela Jefferson, Eaton, OH (US); Krista Beth Comstock, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 106 days.

(21) Appl. No.: 10/969,668

(22) Filed: Oct. 20, 2004

(65) Prior Publication Data

US 2006/0081178 A1 Apr. 20, 2006

(51) Int. Cl.
*B05B 5/00* (2006.01)
*B05B 7/06* (2006.01)
*B03C 3/00* (2006.01)

(52) U.S. Cl. ..... 118/629; 118/313; 239/696; 96/53

(58) Field of Classification Search ..... 118/620, 118/621, 627, 629, 313; 96/27, 53, 71; 239/690, 239/696; 427/475, 479, 483; 95/71
See application file for complete search history.

(56) References Cited

U.S. PATENT DOCUMENTS 2,525,347 A * 10/1950 Gilman ..... 96/27
6,471,753 B1 * 10/2002 Ahn et al. ..... 96/27
6,656,253 B1 12/2003 Willey et al.
2002/0007869 A1 1/2002 Pui et al.
2004/0089156 A1 5/2004 Gartstein et al.

FOREIGN PATENT DOCUMENTS

EP 0 404 344 A1 12/1990
EP 1 253 626 A2 10/2002

OTHER PUBLICATIONS

U.S. Appl. No. 10/969,633, filed Oct. 20, 2004, Willey et al.
International Search Report date Feb. 24, 2006, 5 pages.

* cited by examiner

*Primary Examiner*—Yewebdar Tadesse
(74) *Attorney, Agent, or Firm*—James Derry; Leonard W. Lewis

(57) ABSTRACT

A nozzle spray head is provided for use in a dynamic electrostatic air filter, in which the nozzle spray head assembly exhibits multiple nozzle orifices as outlet ports, which extend from the bottom of the nozzle body such that the distances between the outlet ports and a target member are not constant. The charged multiple outlet ports exhibit a more uniform electric field at their tips, thereby enabling a better and more uniform spray pattern to be emitted by each of the individual outlet ports. In one embodiment, the outlet ports are grouped in concentric circles, in which the innermost circle comprises outlet ports of the greatest lengths, and the outermost circle comprises outlet ports of the smallest lengths.

20 Claims, 12 Drawing Sheets

ELECTROSTATIC NOZZLE APPARATUS

TECHNICAL FIELD

The present invention relates generally to spray nozzle equipment and is particularly directed to nozzles of the type which spray electrostatically charged liquid droplets to collect particulate matter in an air stream. The invention is specifically disclosed as an electrostatic nozzle having a nozzle body that exhibits multiple outlet ports that are of varying length to overcome the otherwise non-uniform high voltage electric field effects on each of the nozzle outlets. The varying lengths of the nozzle outlet ports (or tubes) tends to more evenly distribute the electric field at those outlet ports, thereby enabling a better and more uniform spray distribution pattern for each of the outlet ports. While the differential voltage between the nozzle outlet ports and the target surface may be equal, the electric field will not be equal for all nozzles, due to interference effects from one adjacent nozzle outlet port to the next, unless steps are taken to vary the distance between the target surface and various of the nozzle outlet ports. Alternatively, the differential voltage between the target surface and the nozzle outlet ports could be varied for different groups of the nozzles.

BACKGROUND OF THE INVENTION

Electrostatic spray nozzles with multiple outlets are fairly well known in the art, and in most of the conventional devices, all of the individual outlet ports are of the same length. This uniform length, however, does not cause a uniform electric field to exist at the tips of the individual outlet ports, which thereby causes different spraying patterns to occur for different outlet ports. Since all of the tips are at the same high voltage value, they tend to interfere with one another with regard to the magnitude and direction of the electric fields at those very same tips.

In U.S. Patent Application Publication No. U.S. 2002/0007869 A1 (to Pui) the nozzle lengths have been varied, however, the distances between each of the tips for the nozzle outlet ports and the target surface has remained the same. This relationship can be seen in FIG. 5A of Pui. The main objective of Pui is to spray charged particles (or droplets) onto a targeted surface, regardless of the size of the outlet port diameters of the individual nozzles, and regardless of the size of the droplets that are produced by those outlet ports. This type of arrangement is not suitable for an "air cleaning" application, in which the charged spray droplets are meant to produce a spray cloud within a predetermined space to remove particulate matter from a stream of "dirty" air.

In the conventional nozzle spraying systems, the charging voltage is a single value for all of the individual nozzles, and since the distance between the individual nozzle outlet ports and the target surface is essentially equal for all nozzles, the electric field strength at the tips of each of the individual nozzles will not be constant due to the proximity of one charged nozzle to the next. Therefore, the individual nozzles will not spray in a uniform manner (from one nozzle to the next). Instead, the spray patterns will vary, mainly depending upon the actual electric field magnitude at each of the nozzles. In general, some of the inner nozzles will exhibit an electric field magnitude that is much lower than the electric field magnitude at some of the outer nozzles; the lower field strength nozzles will produce smaller, and probably less well dispersed, spray patterns.

It would be an improvement to build a multiple-outlet port electrostatic nozzle that provides a more uniform, or a substantially uniform, electric field at each of the outlet port tips.

SUMMARY OF THE INVENTION

As noted above, it is an improvement to build a multiple-outlet port electrostatic spray nozzle head that provides a more uniform, or a substantially uniform, electric field at each of the outlet port tips. This can be accomplished in two main ways: (1) to charge some nozzle tips at one voltage, and to charge others at a second, different voltage; or (2) to charge all the nozzle tips at substantially the same voltage, but to vary the distance between some of these nozzle tips so that they are somewhat closer to the target, thereby making it easier for those particular nozzle tips to achieve a greater electric field strength so that these nozzle tips can achieve a more substantial, and better dispersed, pattern of charged spray droplets.

It is an advantage of the present invention to provide an electrostatic nozzle apparatus that exhibits multiple outlet ports for a single spray head, in which at least some of the outlet ports are situated at different distances from a target surface.

It is another advantage of the present invention to provide an electrostatic nozzle apparatus that exhibits multiple outlet ports for a single spray head, and to provide an electric field that is more evenly distributed among the outlet ports to enable better and more uniform spray pattern characteristics.

It is a further advantage of the present invention to provide an electrostatic nozzle apparatus that exhibits multiple outlet nozzle ports for a single spray head, in which the distances to a target surface for the outlet nozzle ports varies from one nozzle port to another; and in particular, the outlet nozzle ports can be arranged in concentric rings, in which the innermost ring has the longest outlet nozzle ports (having the shortest distance to the target surface) and the outermost ring has the shortest outlet nozzle ports (having the longest distance to the target surface).

It is yet another advantage of the present invention to provide an electrostatic nozzle apparatus that exhibits multiple outlet nozzle ports for a single spray head, in which the lengths of the outlet nozzle ports are substantially constant, however, more than one charging voltage is provided so that some of the outlet nozzle ports exhibit a voltage magnitude that is greater than others of the outlet nozzle ports.

It is still another advantage of the present invention to provide an electrostatic nozzle apparatus that exhibits multiple outlet nozzle ports for a single spray head, in which the lengths of the outlet nozzle ports are substantially constant, however, the target surface itself is shaped in a non-planar manner so as to create different distances between the target surface and various of the multiple outlet nozzle ports.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an electrostatic nozzle apparatus is provided, which comprises: a nozzle spray head having: a nozzle body, a fluid inlet at a first surface of the nozzle body, a plurality of fluid outlets at a second surface of the nozzle body, the plurality of fluid outlets comprising a plurality of individual nozzle outlet ports, an internal fluid channel between the fluid inlet and fluid outlets, and an electrode that is electrically charged to a predetermined first voltage magnitude, wherein the electrode is positioned proximal to the fluid channel and imparts an electrical charge to at least a portion of a fluid moving through the fluid channel; and a target member that is spaced-apart from the plurality of individual nozzle outlet ports, the target member exhibiting a proximal surface that faces the plurality of individual nozzle outlet ports; wherein the plurality of individual nozzle outlet ports extend predetermined lengths from the second surface of the nozzle body to one of a plurality of outlet orifices, such that a plurality of predetermined distances are created between the plurality of outlet orifices and the proximal surface of the target member, and wherein the predetermined distances between the proximal surface and the plurality of outlet orifices are not constant, from one of the plurality of individual nozzle outlet ports to another one of the plurality of individual nozzle outlet ports.

In accordance with another aspect of the present invention, an electrostatic nozzle apparatus is provided, which comprises: a nozzle spray head having: a nozzle body, a fluid inlet at a first surface of the nozzle body, a plurality of fluid outlets at a second surface of the nozzle body, the plurality of fluid outlets comprising a plurality of individual nozzle outlet ports that extend predetermined lengths from the second surface of the nozzle body to one of a plurality of outlet orifices, an internal fluid channel between the fluid inlet and fluid outlets, and an electrode that is electrically charged to a predetermined first voltage magnitude, wherein the electrode is positioned proximal to the fluid channel and imparts an electrical charge to at least a portion of a fluid moving through the fluid channel; and a target member that is spaced-apart from the plurality of individual nozzle outlet ports, the target member exhibiting a proximal surface that faces the plurality of individual nozzle outlet ports; wherein the plurality of individual nozzle outlet ports are sized and positioned in a manner that tends to minimize a gradient in an electric field magnitude between one of the plurality of outlet orifices and another one of the plurality of outlet orifices.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
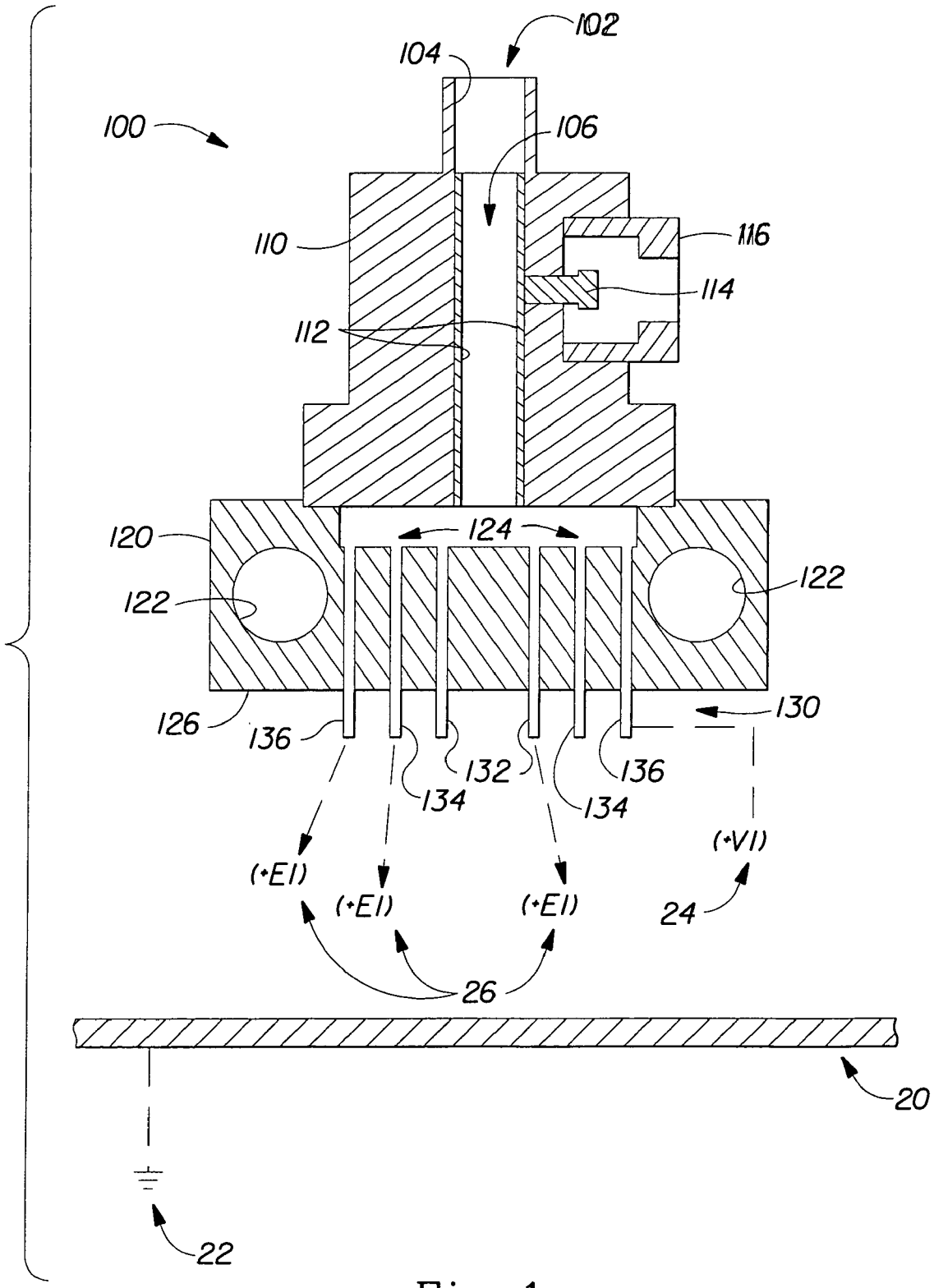
FIG. 1 is a side, elevational view in cross-section of a multi-port nozzle, as constructed according to the principles of the present invention.

Referring now to FIG. 1, an electrostatic spray nozzle is illustrated, and is generally designated by the reference numeral 100. The apparatus 100 is actually a multi-nozzle spray head, in which several individual nozzle orifices are used to increase the volume and density of a spray cloud. A fluid inlet is illustrated at the arrow 102, which comprises a cylindrical outer wall 104. A working fluid passes through the inlet 102, and then continues through a pathway or channel at 106 within an upper nozzle body portion 110. This upper body portion 110 will typically be made of a non-conductive plastic, such as DELRIN®. A conductive metal tube is press fit into this fluid channel 106, in which the metal tube is designated at the reference numeral 112.

A high-voltage electrode 114 is used to make contact with the charging tube 112. The electrode 114 would typically be connected to a high-voltage source via an electrical conductor such as a copper wire (not shown), through an opening at 116 in the side of the upper nozzle body portion 110.

The lower nozzle body portion is designated by the reference numeral 120, and includes a fluid chamber or reservoir 124 that distributes the fluid (which is now charged) to a number of outlet pathways that make up a group of individual nozzle outlet ports with orifices. These outlet nozzle ports are designated by the reference numerals 132, 134, and 136, and as a group are generally designated by the reference numeral 130. The lower nozzle body portion 120 can have mounting holes at 122, if desired. The bottommost surface (as seen in FIG. 1) is designated at 126, which can also be seen on FIG. 2.

Figure 2:
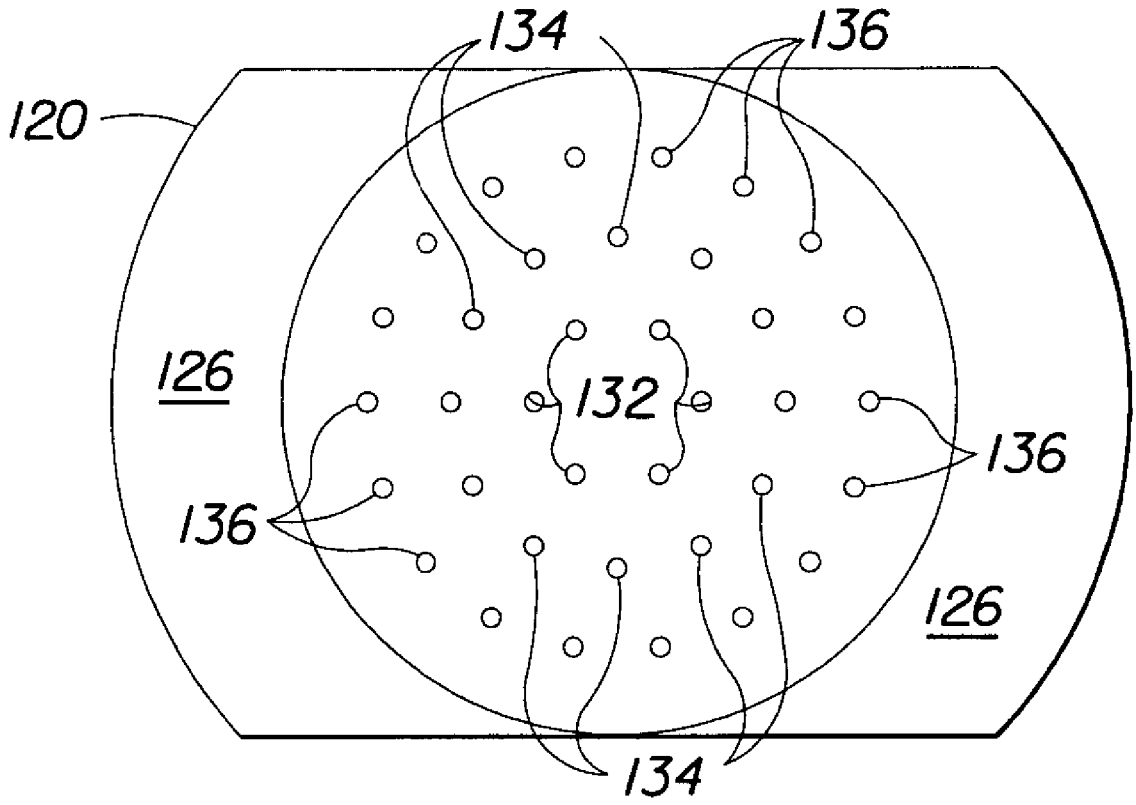
FIG. 2 is a bottom view of the multi-port nozzle of FIG. 1.

The multiple nozzle outlet ports 130 may comprise a set of small diameter stainless steel tubes that are press fit through the bottom surface 126 and through the bottom portion 120 of the nozzle body into the fluid reservoir or chamber 124. The individual nozzle tubes 130 can be placed in a pattern of concentric circles (or "rings"), if desired, as can be seen in FIG. 2. The innermost circle of nozzle tubes is designated at the reference numeral 132, while the outermost concentric circle comprises the nozzle tubes designated by the reference numeral 136. The mid-concentric circle or ring comprises a set of nozzle tubes designated by the reference numeral 134. Other patterns of nozzle tube placement can easily be used, as will be seen in later views, without departing from the principles of the present invention.

Figure 3:
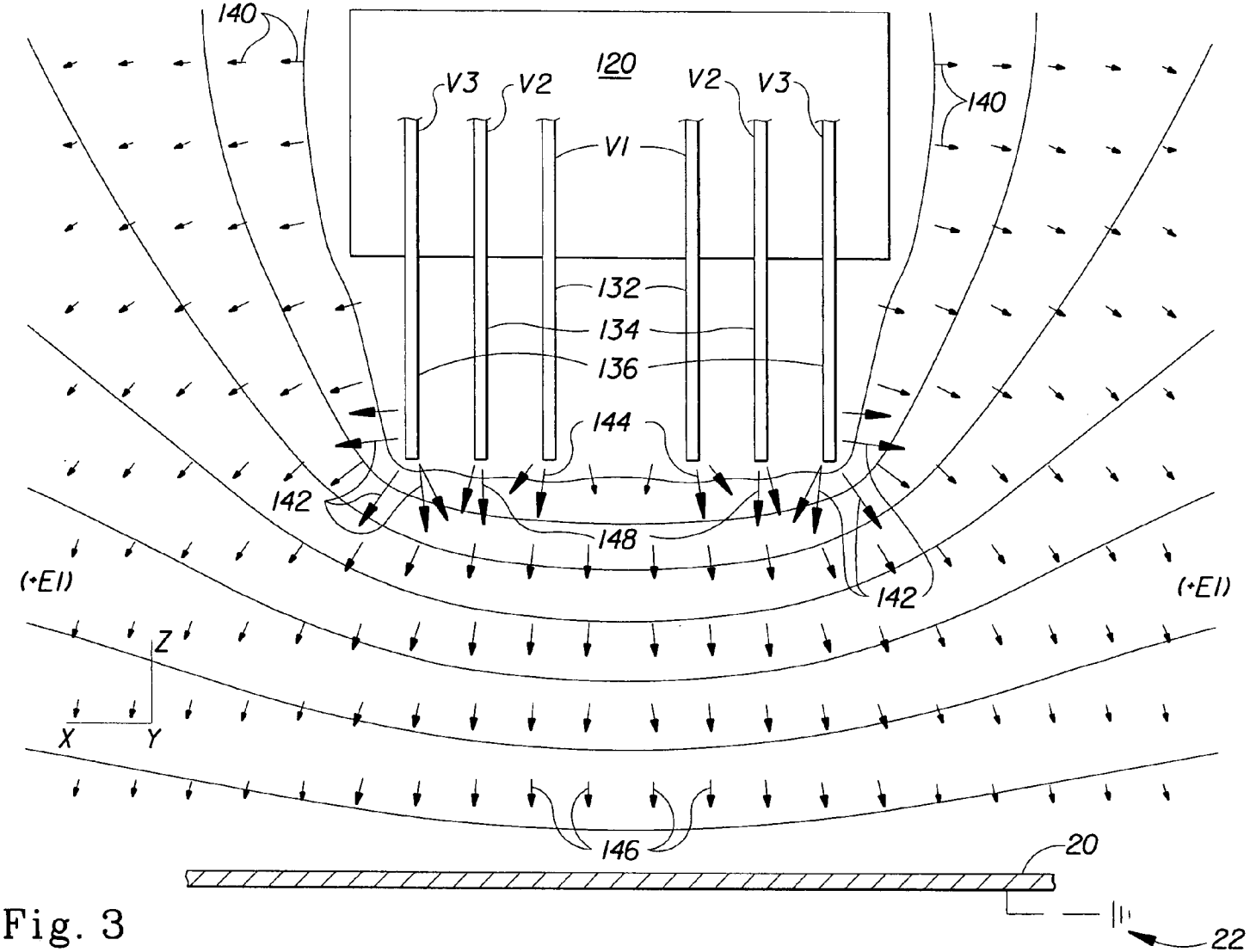
FIG. 3 is a diagrammatic view of an electric field profile produced by the multi-port nozzle of FIG. 1.

If the fluid in the reservoir/chamber 124 is sufficiently charged and a grounded surface (or a surface at a different voltage) is physically present within a given proximity distance, an electric field is generated that will be sufficient to produce an electrostatic spray of fluid from each of the nozzles 130. An example of the electric field profile produced by multiple individual charged nozzles having outlet ports (or tubes) of substantially the same length is depicted in FIG. 3, in which the electric field force vectors are illustrated as two-dimensional arrows, including those at reference numerals 140, 142, 144, 146, and 148. In FIG. 3, each of the nozzle outlet ports (or tubes) 132, 134, and 136 are charged to substantially the same voltage magnitude.

Each individual nozzle port 130 creates an electric field that affects the electric fields produced by adjacent individual nozzle ports. In the embodiment depicted in FIGS. 1–2, when all of the nozzle ports 130 protrude the same distance from the bottom surface 126 of the spray head 100, when the applied voltage +V1 is constant at all nozzle outlets, and when a "target" 20 exhibits an upper planar surface, then the inner concentric ring of nozzle tubes (at 132) may produce either an erratic spray, or will not spray at all due to interference from adjacent electric fields.

In FIG. 1, the target plate 20 is positioned such that it will receive the spray droplets that are emitted from the nozzles 130. For air cleaning applications, it is more important to create a mist "cloud" of electrically-charged droplets exhibiting a substantially uniform size (or diameter) than to create a particular pattern of droplets that strike the surface of target plate 20. The uniformly-sized droplets will tend to be more efficient at collecting particulate matter from "dirty" air that is flowing through a chamber that is partially formed by the target plate 20 and the nozzle body 100.

The exact size and shape of target plate 20 can be left to the system designer. The plate 20 need not always have a planar surface, and in fact other shapes can be quite useful, as discussed below. The target plate 20 may be fixed to a predetermined voltage magnitude, although for many applications it is preferably fixed to ground potential, as illustrated in FIG. 1 at reference numeral 22. Since the fluid is electrically charged within nozzle body 100, the nozzle outlet ports will also be effectively charged to a potential, designated +V1 on FIG. 1, at reference numeral 24. The exact voltage magnitude and polarity may be left up to the system designer, and a suitable voltage may be quite different for one application as compared to another. Of course, the polarity of "+" is only used herein for convention, and the voltage could be of a negative polarity as compared to ground potential.

If a voltage of +V1 is exhibited at the nozzle outlet ports, then each of these outlet ports 132, 134, and 136 will exhibit a positive electric field along their surfaces, including at their nozzle tips. On FIG. 1, this electric field is generally designated as +E1, at the reference numeral 26. However, it should be noted that the magnitude and direction of the vector quantities +E1 will vary considerably at different locations along the nozzle outlet tubes. Moreover, if the distance between the target plate 20 and the tips of the outlet tubes is a substantially constant value (as in the arrangement of FIG. 1), then the electric field magnitudes at the tips of the innermost nozzle tubes 132 will be measurably greater than the electric field magnitudes at the tips of the outermost nozzle tubes 136. This phenomena is discussed in greater detail immediately below, in reference to FIG. 3.

FIG. 3 illustrates a cross-section of the profile of the electric fields (+E1) produced by a spray head such as that depicted in FIGS. 1 and 2, in which the spray head 100 exhibits three concentric rings of nozzle tubes (i.e., the nozzles at 132, 134, and 136). When the charging voltage is constant (or uniform) for all nozzle tubes, the electric field strength of the outer ring (i.e., created by the nozzle tubes 136) when producing a high quality spray is approximately 60% greater than the field strength of the innermost ring (i.e., created by the nozzle tubes 132), and this can be seen by inspecting the magnitudes of the electric field strength arrows at 148 (for the outermost nozzles) as compared to the electric field strength arrows 144 (for the innermost ring of nozzles). This will occur when the target plate 20 exhibits a substantially flat or planar top surface (as viewed in FIG. 3), even though the voltage magnitudes V1, V2, and V3 are substantially equal (respectively, for nozzle group 132, 134, and 136).

Because of electric field interference, the nozzles of the two inner rings (i.e., the nozzle tubes 132 and 134) exhibit an insufficient electric field strength to produce a good quality spray, and the likely result will be sputtering or dripping of the charged fluid out of the nozzle (at least when the nozzles are pointed downward as in the example of FIG. 1). If the overall voltage that charges the fluid is sufficiently increased, then all the nozzles will eventually be forced to spray rather than drip or sputter, but this increased voltage may result in having the outer nozzles (i.e., nozzles 136) become over-charged, which can produce an uncontrolled multi-ligament spray produced by the outer nozzle tubes 136.

A more uniform electric field profile would be beneficial, which could produce a high quality spray from each of the nozzles. This is particularly important if the electrostatic spray nozzle is to be used in an air cleaning apparatus, since a fine, substantially even spray of droplets will more uniformly clean a cross-sectional area of an air column flowing through such an air cleaning apparatus. Individual nozzles that merely sputter or drip will not aid in creating a high quality "even" spray of droplets, and thus will probably allow much particulate matter to flow through the "gaps" in the droplet spray pattern (or "mist cloud") thereby formed by such sputtering or dripping nozzle outlet ports.

Another factor for uniform, high-quality cleaning of particulates from a moving stream of "dirty" air is for the charged spray droplets to exhibit a substantially uniform size or diameter. To form uniformly-sized spray droplets, it typically is necessary to use nozzle tubes with outlet ports that exhibit substantially uniform diameters. The precise size used for the nozzle outlet ports can be left to the system designer, and it should be remembered that other factors also come into play when determining a desired air cleaning efficiency for a given installation. For example, the density of spray droplets and the exit velocity of the spray droplets is important, as well as the voltage magnitude impressed onto the droplets and the length of time that the droplets can maintain a useful voltage after exiting the nozzle outlet ports.

It should be noted that many other applications for use of the spray nozzle of the present invention are benefited by use of a high quality "even" spray of droplets. For example, in the automotive industry many parts are spray painted using very high voltages to charge the paint fluid, yet small clumps of paint still occur in the conventional systems. Other types of materials are surface-coated by charged particles that may clump, even at very high charging voltages. The present invention can be used to create a more even, fine mist of charged droplets, and thus eliminate many or all clumps from being formed. Another example is the use of charged droplets in certain chemical reactions. Many gasoline (or other hydrocarbon-fueled) engines use fuel injectors, and a fine fuel mist that is more even in density (and with little or no clumping) is quite beneficial in many combustion reactions. Even if it would be desired to create a stratified (non-uniform) density of fine droplets, then the present invention could be used to more precisely create a predetermined non-uniform density by varying the lengths of the individual outlet nozzle tubes accordingly (using a planar target surface), or by keeping the lengths of the outlet nozzle tubes substantially constant while re-shaping the target surface so that it is not planar (which is discussed below in greater detail).

One way to overcome the variations in the electric field strength of the nozzle spray head of FIG. 3 is to charge different nozzle tubes to different electrical potentials. In FIG. 3, the innermost concentric ring of nozzle tubes 132 could be charged to a voltage V1, while the middle concentric ring of nozzle tubes 134 could be charged to a different voltage V2 that is less than V1, and further, the outermost concentric ring of nozzle tubes 136 could be charged to a yet different voltage V3, which is less than V2. While this type of high voltage charging system may be more difficult to construct, it would nevertheless accomplish the goal of providing a more uniform electric field strength profile over all of the nozzle tubes, which would then tend to accomplish the overall goal of providing a more uniform spray pattern that is both "better" dispersed, and which created a cloud (or mist) of relatively fine spray droplets, for all of the nozzle tubes 132, 134, and 136. The electric field profile depicted in FIG. 3 would be significantly altered, and would have the appearance more like that depicted in FIG. 6, which is discussed below (for a different nozzle tube construction).

One must be careful, however, to not "over-charge" the innermost nozzles. The voltage levels should not be allowed to reach magnitudes (e.g., greater than 40 kV or 50 kV) that might cause excess leakage current, or which may induce periodic arcing or flashover between the nozzle tubes of different charging voltages, or perhaps may even cause tracking to occur along the bottom surface 126 of the nozzle spray head (which would then degrade the insulation characteristics of that bottom surface). If a superior spray pattern is not achievable for a particular nozzle head design (i.e., using the "constant" nozzle tube lengths), then an alternative design of the present invention could instead be utilized, as discussed below.

Figure 4:
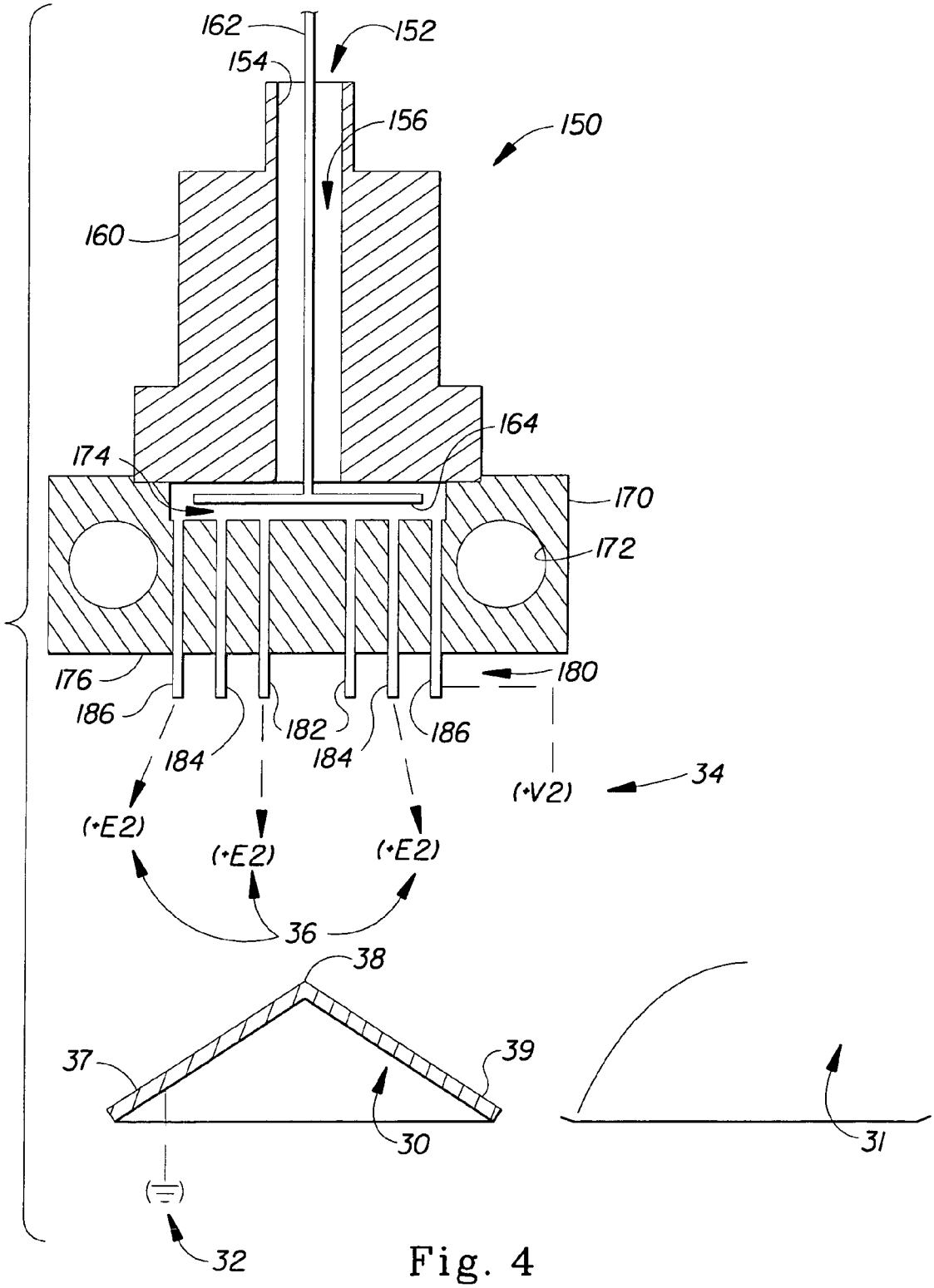
FIG. 4 is a side, elevational view in cross-section of an alternative construction similar to the nozzle of FIG. 1, in which the target surface is not planar.

An alternative embodiment of a multi-nozzle spray head is depicted in FIG. 4 by a multi-port spray nozzle generally designated by the reference numeral 150. The nozzle 150 exhibits an inlet port at 152 which is created by a cylindrical opening 154, through which the fluid passes into a fluid pathway or channel 156 that extends to a fluid chamber or reservoir at 174. The upper body portion is depicted by the reference numeral 160, and this upper body portion includes a charging electrode that extends completely through the fluid inlet 152 and the fluid pathway 156. This electrode is designated by the reference numeral 162 as a longitudinal rod that extends along the longitudinal axis of the fluid pathway 156. At the bottom (as seen on FIG. 4) of the rod 162 is a disk (or other shape) having a substantially planar surface at 164, which fits within the fluid reservoir 174. The fluid reservoir 174 is created in the bottom portion of the nozzle body, generally designated by the reference numeral 170. This bottom portion of the nozzle body can include mounting holes at 172, if desired. The bottom nozzle body portion includes a lower (or bottom) surface at 176 (as seen on FIG. 4).

There are multiple nozzle tubes extending from the fluid reservoir 174 through the bottom surface 176 and, as a group, these nozzle tubes are generally designated by the reference numeral 180. As can be seen in FIG. 4, there are three concentric rings of individual nozzle tubes 180, an innermost ring of nozzles at 182, an outermost ring of nozzles at 186, and a middle concentric ring of nozzles at 184. In this configuration, these nozzles would have the same appearance from the bottom as that illustrated in FIG. 2. Other patterns of nozzle placement could of course be used, without departing from the principles of the present invention.

The nozzle body 150 of FIG. 4 would exhibit similar electrostatic spraying characteristics as compared to the nozzle body 100 of FIG. 1 under the same conditions, i.e., a constant voltage at the nozzle tips and a substantially planar target surface (as seen at 20 in FIG. 1). However, in FIG. 4, the target, generally designated by the reference numeral 30, is not planar along its upper surface, and instead exhibits an upper "peak" at 38 and two lower sloped surfaces at 37 and 39. This shape could represent the cross section of a conical outer surface, for example, for target 30. In this example of FIG. 4, the target 30 is connected to earth ground, while the nozzles are charged to a substantially constant voltage +V2 at 34, which creates an electric field +E2 at reference numeral 36.

It should be noted that the non-planar shape of target 30 aids in creating an electric field magnitude that is more equal, or substantially equal (or uniform) at the tips of the nozzle outlet ports, for nozzle tubes 182, 184, and 186. Even when the induced voltage +V2 is constant for all outlet nozzles, this configuration will allow the various nozzle tubes 182, 184, and 186 to create a cloud spray pattern that is more uniform than that produced by the nozzle configuration 100 of FIG. 1 when a constant voltage +V1 was applied to all nozzle tubes 132, 134, and 136. This is mainly achieved by reducing the distance between the innermost nozzle tubes 182 and the target surface 30 at or near the peak 38, as compared to the distances between target surface 30 and the intermediate and outermost nozzle tubes 184 and 186, respectively. An example of such a more equal or more uniform electric field is discussed in greater detail below, in reference to FIG. 6.

FIG. 4 also illustrates an alternatively-shaped target at reference numeral 31, which exhibits more of a parabolic profile in cross-section. If this target 31 is placed beneath the nozzle body 150, then the distance between the uppermost portion of the parabolic target 31 and the innermost nozzle tubes 182 again would be less than the distances between the parabolic target 31 and the intermediate and outermost nozzle tubes 184 and 186, respectively. This configuration would also aid in creating an electric field magnitude that is more equal, or substantially equal (or uniform) at the tips of the nozzle outlet ports for nozzle tubes 182, 184, and 186, including when the induced voltage +V2 is constant for all the outlet nozzles.

Figure 5:
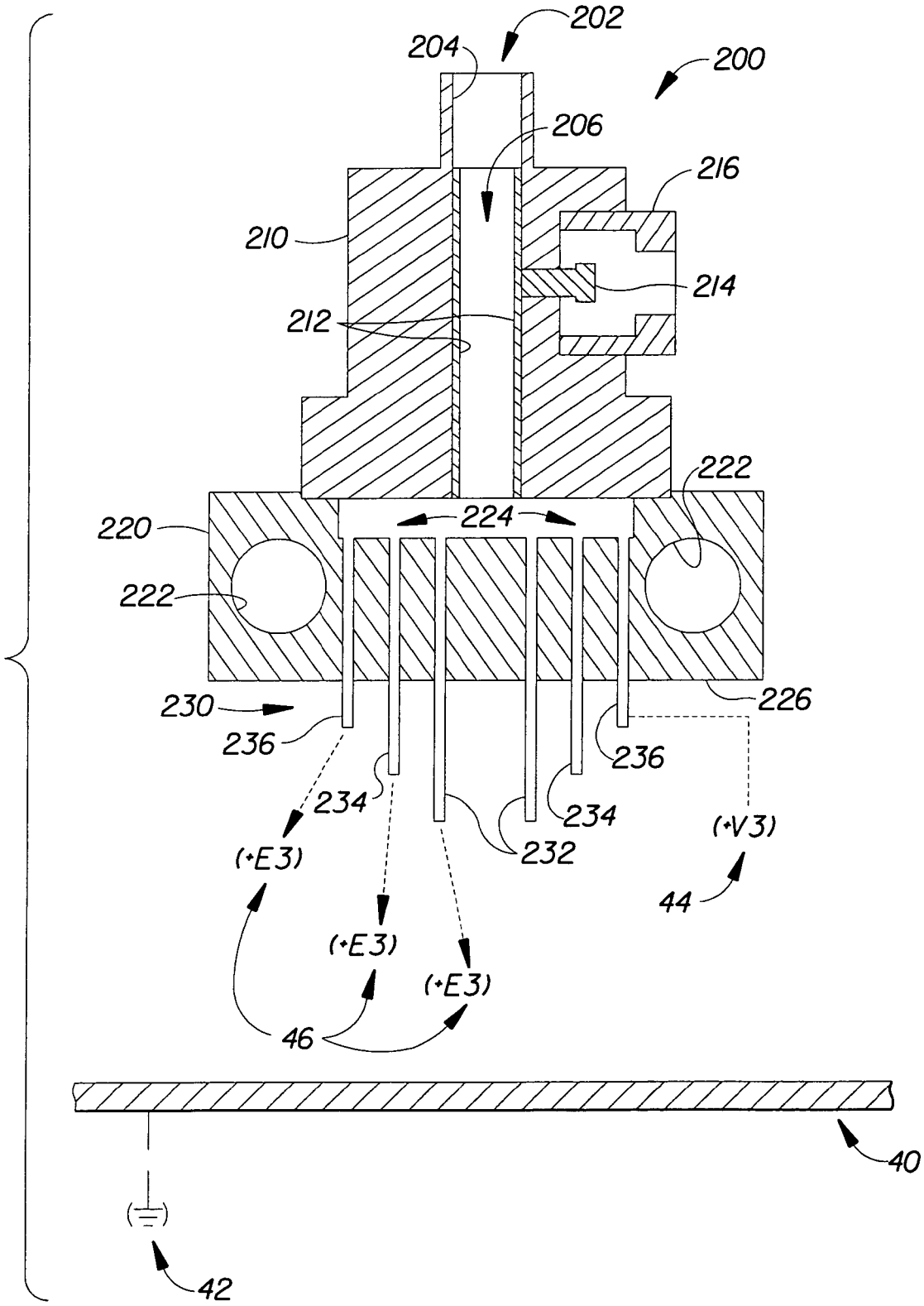
FIG. 5 is a side, elevational view in cross-section of a multi-port nozzle in which the nozzle tips are at non-uniform distances from the target surface, as constructed according to the principles of the present invention.

One other way to achieve a more uniform electric field profile is to configure the nozzles such that the innermost nozzles extend further from the bottom surface of the nozzle body, as compared to the distance that the outermost nozzles extend from that nozzle body. In this configuration, the nozzles will be "staggered" with regard to their distances between their tips and a planar target surface. An example of such a configuration is illustrated in FIG. 5, depicting a nozzle spray head generally designated by the reference numeral 200.

The nozzle spray head 200 includes a fluid inlet or port at 202 that is formed by a cylindrical wall at 204. This inlet 202 is in communication with a fluid pathway or channel 206 that extends throughout the upper portion 210 of the nozzle body. In a similar manner to the exemplary nozzle of FIG. 1, a charging tube member 212 can be press fit into this fluid pathway 206, which is made of an electrically conductive material, while the nozzle body itself would preferably be made of a non-conductive material, such as plastic (e.g., DELRIN). An electrical conductor 214 can form an electrode, to which an electrical conductor is attached through an opening 216, which will electrically charge the fluid passing through the pathway 206 to a high voltage, thereby creating a charged fluid that can be used as an electrostatic spray.

The lower portion of the nozzle body is generally designated at 220, which can include one or more mounting holes at 222. The lower or bottom surface of the nozzle body is illustrated at 226. A fluid reservoir or chamber is formed at 224 within the lower body portion 220. If an electrical charge is imparted onto the fluid before reaching the reservoir 224, then the inner surfaces of the reservoir (along with the fluid itself) will be raised to a potential, such as a voltage +V3.

A set of individual nozzles extends from the reservoir 224 through the bottom surface 226 of the nozzle body, and this set of nozzles as a group is generally designated by the reference numeral 230. The individual nozzles of nozzle group 230 can be positioned in a set of concentric rings, in which the innermost ring is comprised of nozzles 232, the outermost ring is comprised of nozzles 236, and a mid-concentric ring is comprised of nozzles 234. This configuration of individual nozzles can have the appearance of FIG. 2 when viewed from its bottom (as per FIG. 5), if desired. Of course, other nozzle placement patterns could be utilized without departing from the principles of the present invention.

When viewed from the side (as in FIG. 5), the "staggered" effect can be readily discerned, in which the distances between the nozzle tips of nozzle tubes 232, 234, and 236 and the upper surface of a target plate 40 are not uniform (or equal) throughout all the nozzles 230. In the configuration illustrated in FIG. 5, the target plate 40 is held to ground potential (as indicated at 42), however, that need not always be true. In general, it is desired for there to be a differential voltage between the target plate 40 and the tips of the nozzle tubes, which in FIG. 5, the differential voltage would be equal to +V3, at 44. On FIG. 5, the differential voltage +V3 produces an electric field +E3 at the nozzle outlet ports. It will be understood that the polarity of +V3 need not always be positive; also, the electric field +E3 is not always completely uniform at all locations, even though it is desirable for that field +E3 to be substantially equal (or uniform) at all of the nozzle tips.

When the individual nozzles of the group 230 are charged to the same voltage (which would occur if a charging voltage is applied to the electrode 214, which then imparts a charge to the fluid, which in turn imparts a charge to the nozzles 230), then a more uniform electric field profile will be exhibited across the tips of all of the individual nozzles 230. This will be true because the innermost ring of nozzles (i.e., the nozzles 232) will have a reduced distance between the tip of the nozzle and the ground plate 40 that is beneath the nozzle spray head 200, thereby increasing the effective electric field (+E3) strength for those nozzles 232. In a three-ring configuration (as depicted in FIG. 5 and FIG. 2), the nozzles 232 of the innermost ring will extend the closest to the top surface of plate 40, the nozzles 234 of the mid-concentric ring will extend to a somewhat greater distance from the top surface of plate 40, but will still extend a distance less than a distance that the outermost nozzles 236 extend to the top surface of plate 40.

It will be understood that the present invention could also be achieved by using a combination of a non-planar target member (such as target 30 or target 31, illustrated in FIG. 4) and a set of "staggered" nozzles that exhibit a varying length from the bottom surface of the nozzle body (such as the nozzle tubes 232, 234, and 236, extending from the bottom surface 226). Such a configuration would perhaps be somewhat more expensive to construct, but it could still achieve the goal of using a single voltage source to charge the spray liquid while maintaining varying distances between the nozzle outlet ports and the proximal surface of the target member.

Figure 6:
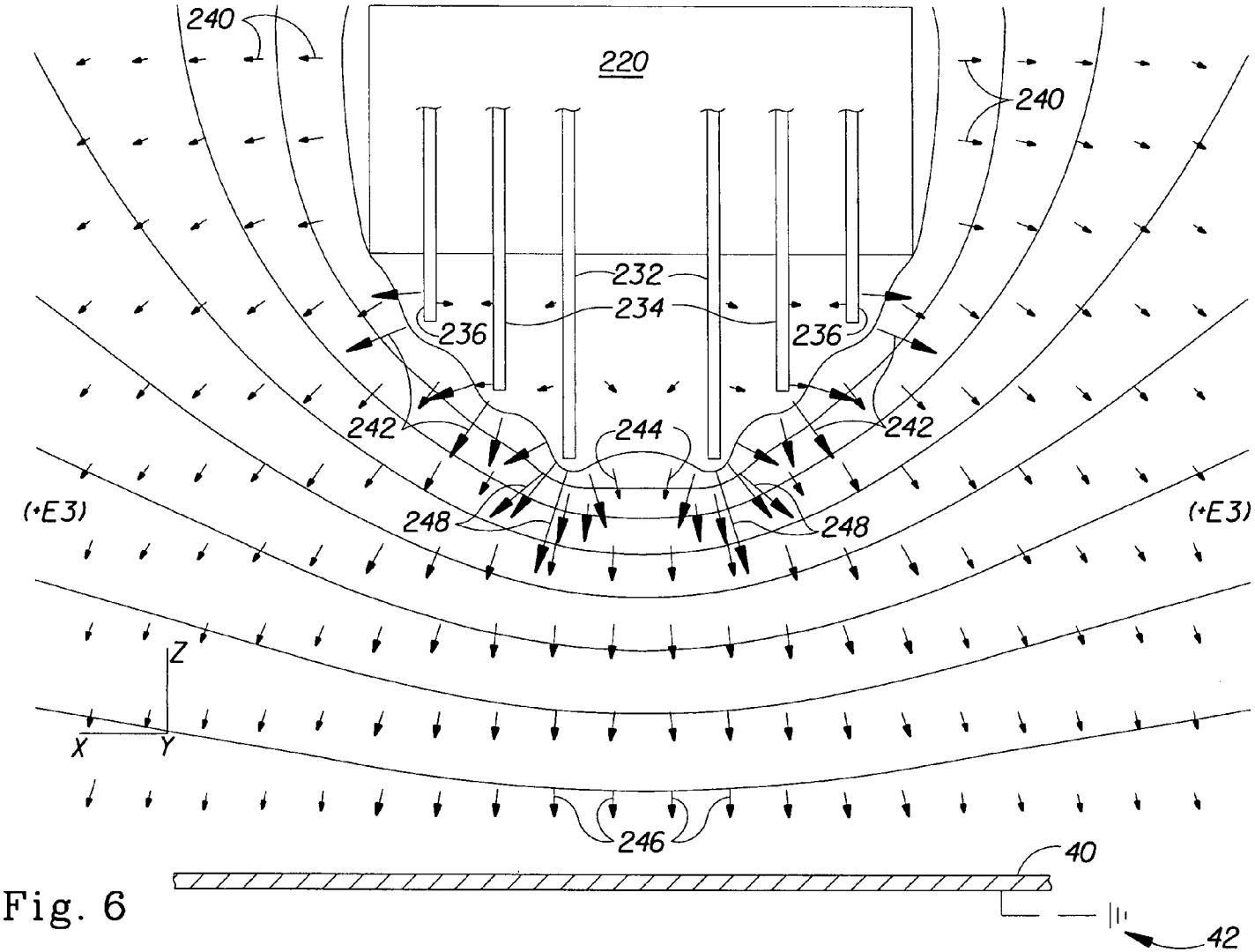
FIG. 6 is a diagrammatic view of the electric field profile produced by the multi-port nozzle of FIG. 5.

An electric field profile (+E3) will be created by the three-ring set of concentric nozzles 230 of the nozzle spray head 200, as illustrated in FIG. 6. The electric field vectors are represented by individual arrows, and it can be seen that the electric field arrows 248 produced by the innermost nozzles 232 have a much greater magnitude than the magnitude of arrows 144 produced by the innermost nozzles 132 on FIG. 3. On FIG. 6, the electric field +E3 is produced by the differential voltage between the grounded plate 40 and the nozzle tubes 232, 234, and 236.

In FIG. 6, the magnitude of the electric field arrows produced by the mid-concentric ring nozzles 234 and the outermost nozzles 236 are depicted at 242, which have a nearly equal magnitude when comparing one ring of nozzles to the other. This is in contrast with respect to the electric field magnitudes produced on FIG. 3 by the mid-concentric ring of nozzles 134 and the outermost nozzles 136, which respectively produced the electric fields at 148 and 142. On FIG. 3, it can be seen that the outermost nozzles 136 produced the greatest electric field magnitudes at 142. The electric field magnitudes along the "sides" of the nozzles (at 140 and 240 on FIGS. 3 and 6, respectively) are relatively small, and are insignificant as compared to the electric fields near the nozzle tips (i.e., at the outlet orifices) which are the closest to the ground plate or grounded surface (not shown on FIG. 5) which acts as the target for the spray droplets being produced at the tips of the nozzles 230. Also, the electric fields at 244 between the innermost nozzle tips for nozzles 232 are comparatively small, as seen on FIG. 6.

In the nozzle configuration of FIG. 6, the individual nozzle outlet ports (i.e., the nozzles 232, 234, and 236) are positioned and sized (i.e., their lengths) so that their individual nozzle outlet orifices (i.e., at the "tips" of these nozzles 232, 234, and 236) are at predetermined locations that tend to minimize a gradient in an electric field magnitude from one nozzle tip to another of these nozzle tips. In other words, the magnitudes of the electric field vectors 242 and 248 on FIG. 6 are more nearly equal to one another, as compared to the magnitudes of the electric field vectors 142 and 148 of FIG. 3, and thus the gradients between these vector magnitudes of electric field vectors 242 and 248 is reduced. This phenomena can also be referred as producing substantially equal electric field strength concentrations.

Figure 7:
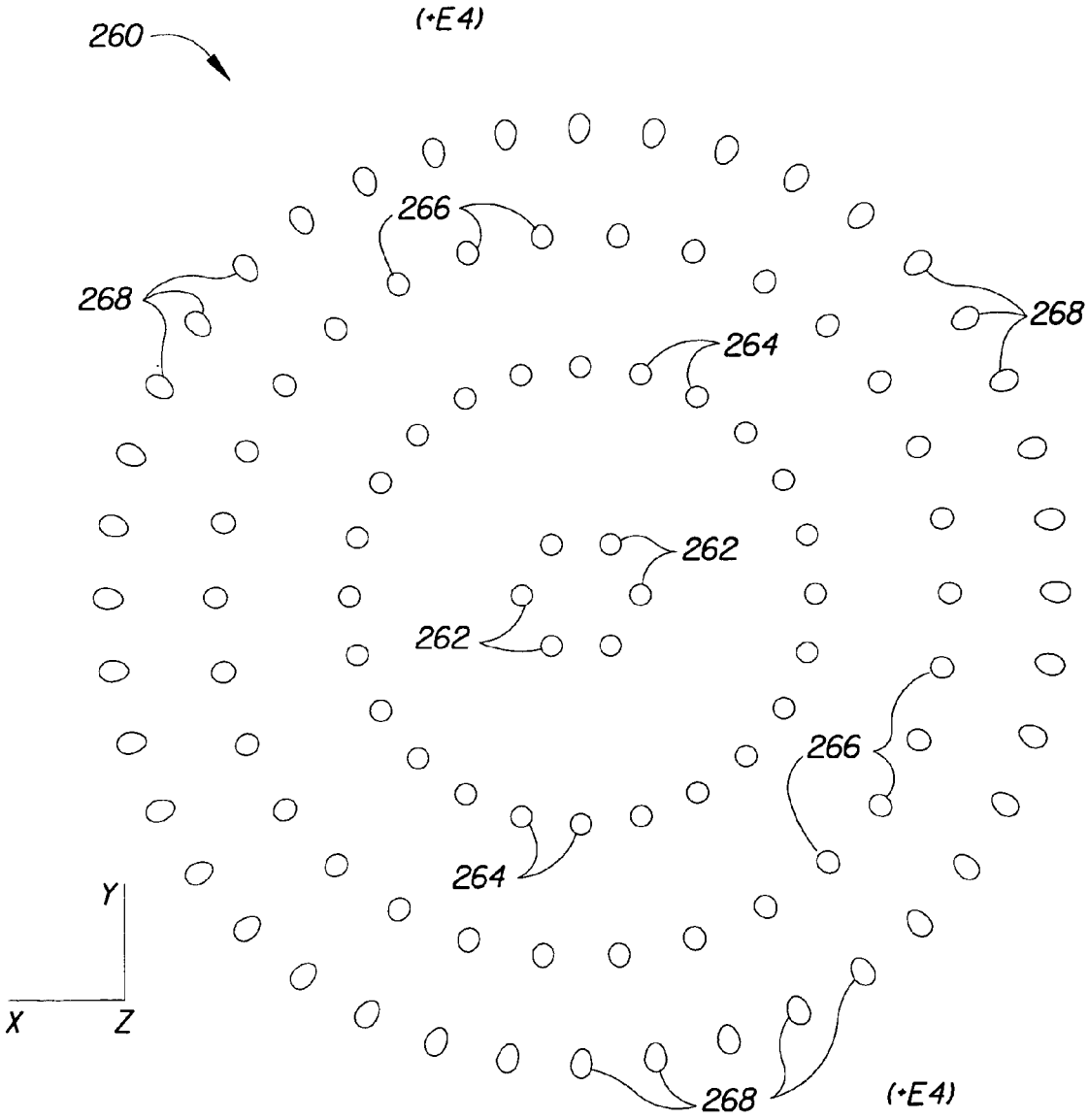
FIG. 7 is a diagrammatic view of the electric field potentials taken at a plane that runs 90° (perpendicular) from the electric field profile drawing of FIG. 6, but is produced by a four-ring multi-port nozzle similar to the nozzle of FIG. 5.

FIG. 7 illustrates an abstraction of an electric field profile 260 created by a series of four concentric rings of nozzles, similar to the three-ring set of nozzles of the nozzle spray head 200 of FIG. 5. In FIG. 7, the electric field profile 260 illustrates an abstraction of the magnitude and vector directions of the electric fields produced at the tip of each of the individual nozzles. In this configuration, there would be a set of nozzles of non-uniform length with respect to the bottom surface of the nozzle body, such that the innermost nozzles extend the farthest from the bottom of the nozzle body (and thus nearest to a planar target 52; see FIG. 8), while the outermost ring of nozzles extends the least distance from the bottom surface of the nozzle body (and thus farthest to a planar target 52; see FIG. 8). This will produce a set of electric fields +E4 that are of near-uniform magnitude (or intensity), if the nozzles are positioned in a similar pattern to that depicted on FIG. 7. In other words, the innermost nozzles will produce electric fields at 262, so long as they are spaced apart from the next outer ring of nozzles producing the electric fields at 264. The spacing between the nozzles producing the field 264 and the next outer set of nozzles producing the electric fields at 266 will be a shorter distance as compared to the spacing between the innermost nozzles (producing the fields at 262) and the second ring of nozzles (producing the fields at 264). The numbers of the individual nozzles also increases with each set of concentric rings extending from the center of the concentric circles. The outermost nozzles produce the field patterns at 268, which again are spaced apart a certain distance from the third ring of nozzles producing the field patterns at 266.

The shapes of each of these electric field patterns on FIG. 7 is approximately proportional to the directions of the electric field vectors that extend from each of the nozzle tips, when seen in a cross-section view represented by a plane that is parallel to the bottom surface of the nozzle body. While the electric field vectors themselves are not illustrated on FIG. 7, they will in fact extend in directions that have a "horizontal" component, which would be parallel to the plane described above. This produces the shapes of the patterns that are illustrated on FIG. 7.

Figure 9:
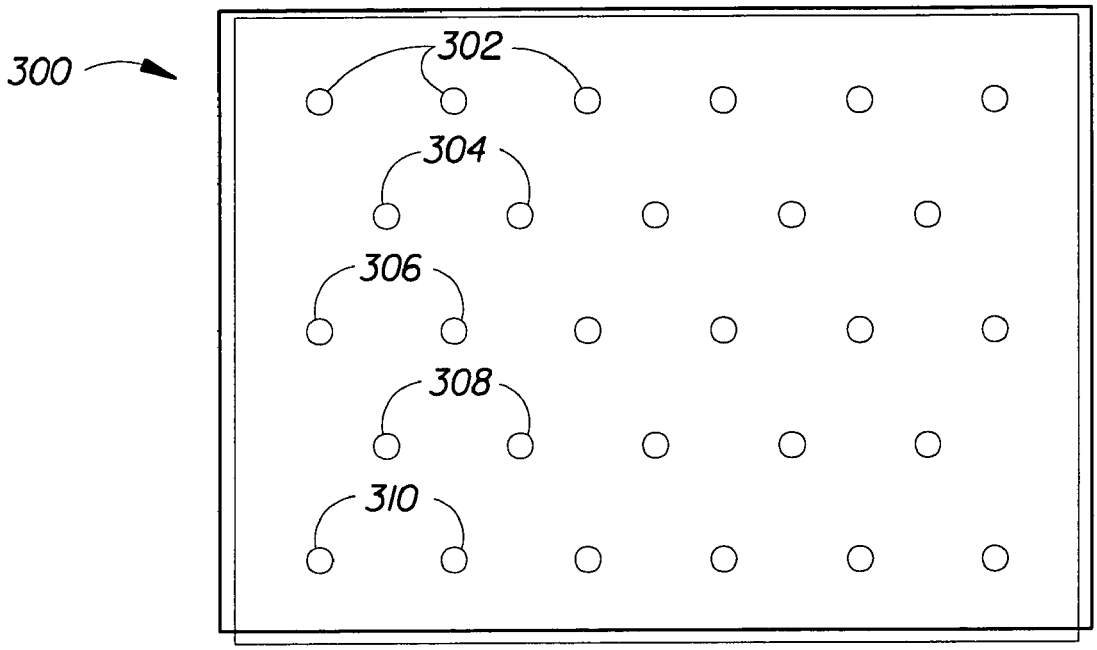
FIG. 9 is a bottom view of a multi-port nozzle having a triangular nozzle tube placement pattern.
Figure 10:
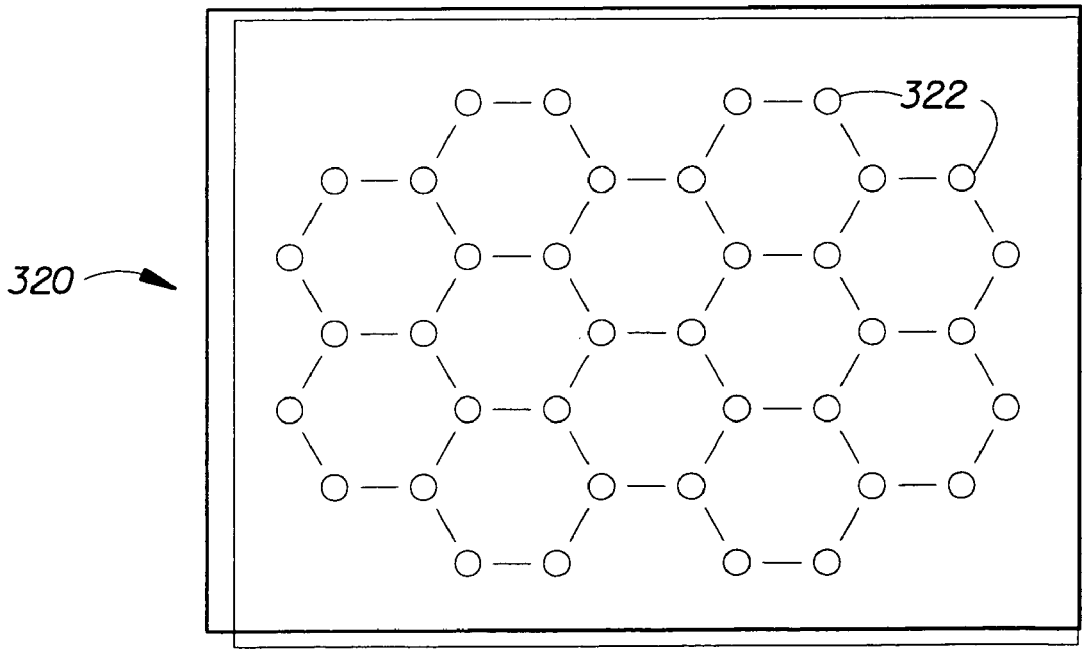
FIG. 10 is a bottom view of a multi-port nozzle having a hexagonal nozzle tube placement pattern.

To further emphasize the fact that alternative placement patterns can be utilized in the present invention, FIGS. 9 and 10 are provided depicting such other example patterns. In FIG. 9, the individual nozzles are grouped in a linear, triangular-type pattern, and as a group are generally designated by the reference numeral 300. The top row of nozzles (on FIG. 9) are designated at 302, and the individual "linear" sets of nozzles are designated 304, 306, 308, and 310, when moving from the top to the bottom on this view. On FIG. 10, the nozzle pattern as a group is generally designated by the reference numeral 320, and is composed of a set of hexagonal cells. Each of the nozzles is designated 322, and each such nozzle forms one of the nodes of three separate hexagonal cells in this example.

Figure 8:
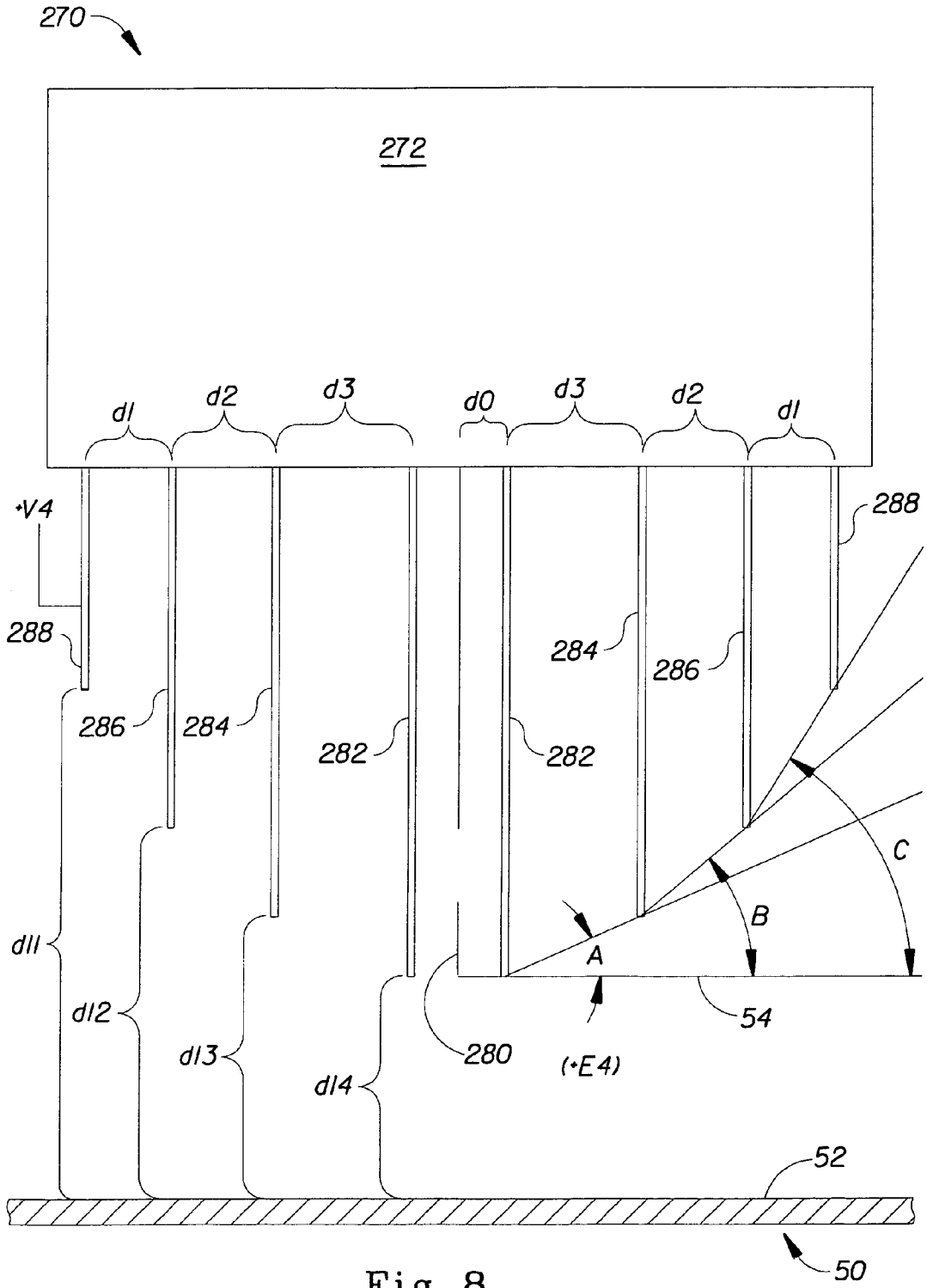
FIG. 8 is a side, elevational view showing certain details of a multi-port nozzle similar to that of FIG. 5, as constructed according to the principles of the present invention.

FIG. 8 depicts a set of nozzles of a nozzle spray head generally designated by the reference numeral 270, in a simplified diagrammatic form that ignores the other structural details of the spray head 270. In FIG. 8, only the bottom body portion at 272 is illustrated, which includes internal fluid passageways (not visible) to direct a charged fluid to each of the individual nozzles or nozzle tubes. The spray head 270 has four sets of concentric rings of nozzles, which could be used to produce the pattern illustrated in FIG. 7, described above. The innermost nozzles are at 282, the second set of concentric nozzles are illustrated at 284, the third set of concentric nozzles are illustrated at 286, and the fourth or outermost set of nozzles are illustrated at 288.

The center line of the concentric nozzles is illustrated at 280, and there are radial distances from the center line and between individual nozzle spacings that will be described immediately below. The distance from the center line 280 to the innermost nozzles 282 is referred to as "d0," the distance between the first or innermost ring of nozzles 282 to the second ring (at 284) is designated "d3," the distance between the second and third rings (at 284 and 286) is designated "d2," and the distance between the third and fourth (outermost) rings (at 286 and 288) is designated "d1." As can be seen, the distance d3 is greater than the distances d1 or d2, however, mere distance alone will not determine the final spray pattern or electric field strength profile. The angles formed by the tips of the nozzles are also important, as described below.

An angle "A" is formed by a line connecting the tips of the first ring of nozzles 282 and the second ring of nozzles 284, as compared to a horizontal line (on FIG. 8) which is also parallel to the upper surface 52 of a planar target plate 50. An angle "B" is formed by a line connecting the tips of the second ring of nozzles 284 and the third ring of nozzles 286, as compared to the same horizontal line that is also parallel to the upper surface 52 of a planar target plate 50. An angle "C" is formed by a line connecting the tips of the third nozzle ring 286 and the tips of the fourth, outermost nozzles at 286, as compared to the same horizontal line that is also parallel to the upper surface 52 of a planar target plate 50.

In some embodiments, angles A, B, and C may be equal, although the distances d1, d2, and d3 may be quite different in proportion as compared to that depicted in FIG. 8. If the angles A, B, C are all equal, then the slopes between the nozzle tips 282, 284, 286, 288 will be co-linear, and thus such a spray head structure will exhibit a uniform slope along its nozzle tips (or outlet ports). In the illustrated arrangement, the distance d11 from the tip of the outermost nozzles 288 to the surface 52 of the target is greater than the distance d12 from the tip of nozzles 286 to surface 52, which is greater than the distance d13 from the tip of nozzles 284 to surface 52, which is greater than the distance d14 from the tip of nozzles 282 to surface 52. These varying distances d11, d12, d13, and d14 tend to produce an electric field +E4 that will exhibit a substantially uniform profile, in which the +E4 field vectors at the nozzle tips will all be of substantially equal magnitudes, even though each of the nozzle tubes 282, 284, 286, and 288 are charged to substantially the same potential +V4.

Figure 12:
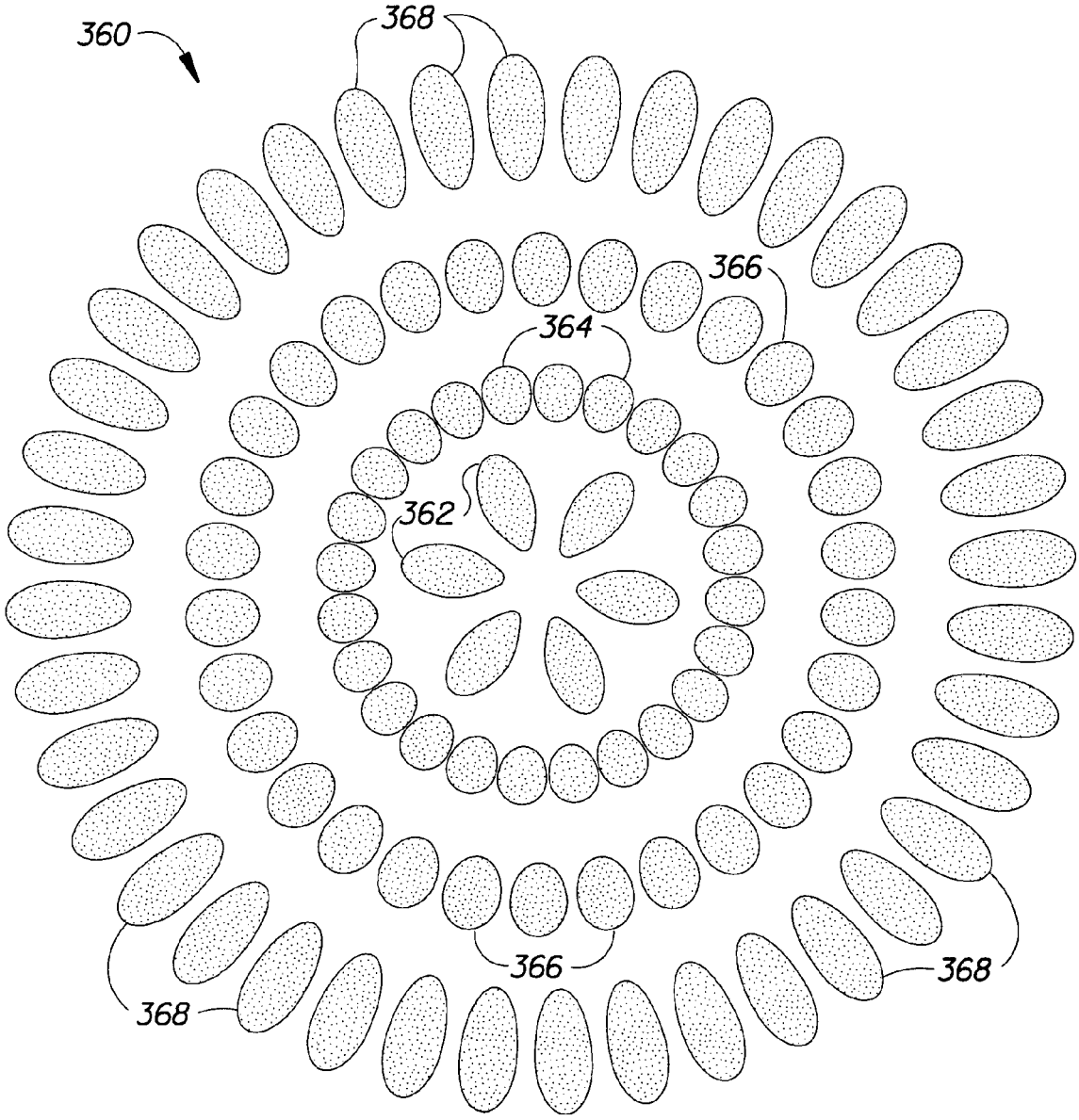
FIG. 12 illustrates a spray pattern of a four-concentric ring multi-port nozzle in which the individual nozzles are of a non-uniform distance from the target surface.

An exemplary spray pattern can be produced if angle A is 9°, angle B is 16°, and angle C is 21°, when using the approximate proportions of distances d1, d2, and d3 of FIG. 8. In this example nozzle arrangement, distances for d0 through d3 were substantially: d0=0.125 inches, d1=0.375 inches, d2=0.25 inches, and d3=0.25 inches. One exemplary spray pattern that was produced is illustrated in FIG. 12, and will be discussed below. It should be noted that, in this example, the charging voltage was in the range of 25–35 kV, the fluid flow rate was in the range of 0.05–0.15 ml/nozzle outlet port, and a grounded "target" for the spray droplets was positioned at a distance in the range of 2.0–3.5 inches from the nozzle outlet ports. In general, it is desired to generate an electric field strength of at least 2 kv/m at each nozzle outlet port, but at the same time to limit the maximum charging voltage to no more than 30 kV (for safety reasons, if nothing else).

Figure 11:
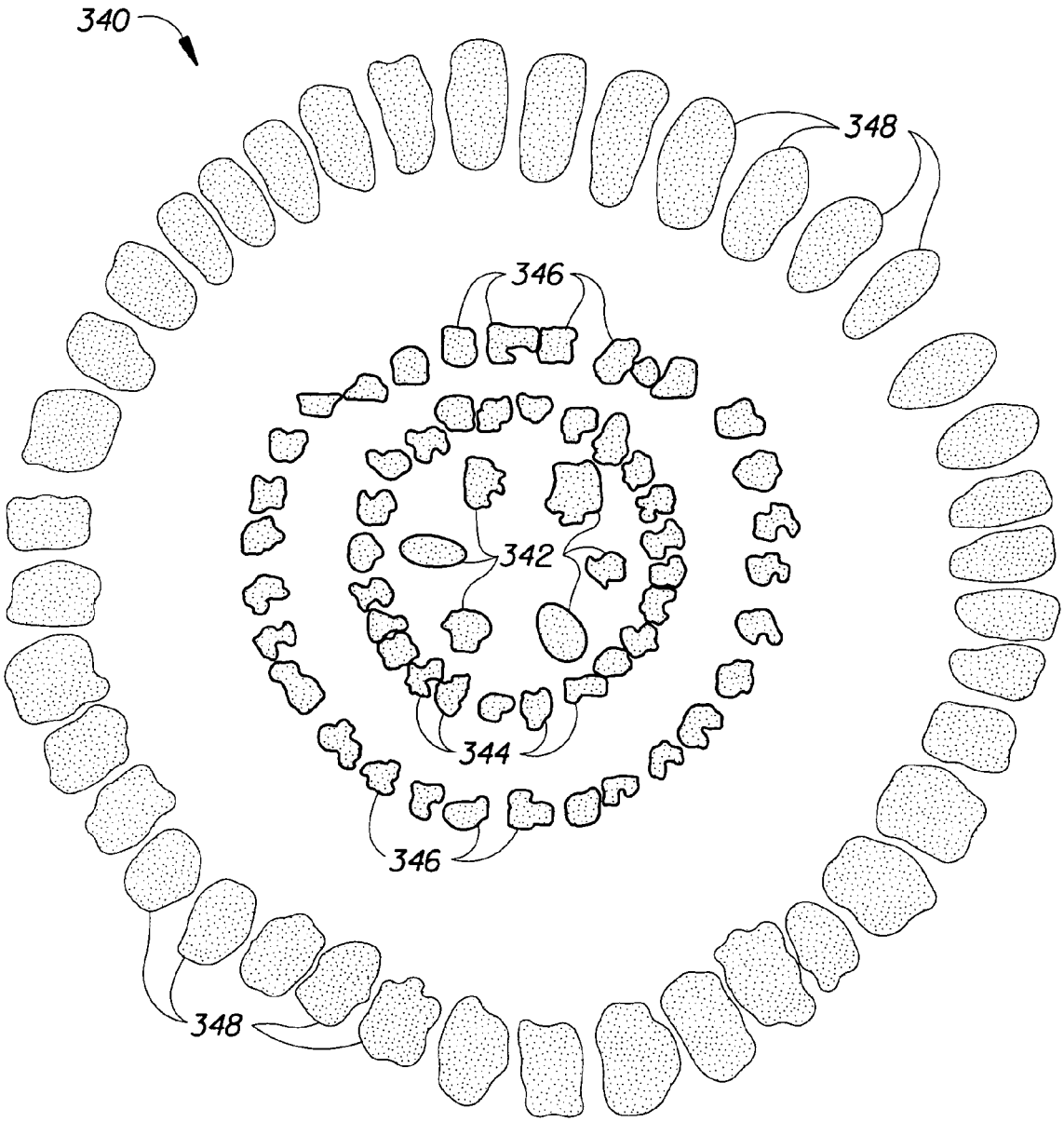
FIG. 11 illustrates a spray pattern of a four-concentric ring multi-port nozzle in which the individual nozzles are of a uniform distance from the target surface.

FIG. 11 illustrates a spray pattern 340 produced by four concentric rings of nozzles that are of uniform length, i.e., each nozzle tube extends substantially the same distance from the bottom surface of the nozzle body, and its tip is substantially the same distance from the surface of a planar target, similar to the three-ring nozzle spray head 100 of FIG. 1. The innermost nozzles do not have a sufficient voltage at their tips, and produce only partial spray patterns at best, and otherwise tend to sputter. The patterns are illustrated at 342, and while some of the patterns may appear as reasonable spray patterns, it is only because the innermost nozzles are spaced farther apart from the next ring of nozzles. The next two rings of nozzles produce irregular patterns at 344 and 346, and these are mainly due to sputtering and dripping of the fluid, rather than any type of desired spray pattern. Only the outermost nozzles produced reasonable spray patterns at 348. This is because the outermost nozzles have the highest electric field potential, which would be expected after inspecting the electric field profile of FIG. 3 for a three-ring set of concentric nozzles.

FIG. 12 also illustrates a spray pattern of a four-ring set of concentric nozzles, generally designated by the reference numeral 360. In FIG. 12, the nozzles are not of uniform length from the bottom of the nozzle body, and also exhibit varying distances from their nozzle tips to a planar target (note: the target planar surface and the bottom surface of the nozzle body are substantially parallel to one another). In this example, the innermost nozzles extend the furthest from the bottom of the nozzle body, and thus come within the nearest distance of the surface of the planar target. This is the type of spray pattern that would be produced by the nozzle set 270 of FIG. 8, in which the angles A, B, and C are at 9°, 16°, and 21°, respectively. The innermost nozzles 282 produce the spray patterns 362, the second ring of nozzles 284 produce spray patterns 364, the third ring of nozzles 286 produce spray patterns 366, and the fourth outermost ring of nozzles 288 produce spray patterns 368. All of these spray patterns are acceptable, and are not due to sputtering or dripping. This would be expected after inspecting the electric field profile of FIG. 6, which depicts a three-ring set of nozzles of non-uniform distances from the surface of the planar target 40.

It will be understood that the optimum angular configuration for nozzle tube lengths of concentric rings of individual nozzles may not be linear for all situations (i.e., in which the slope is uniform between all nozzle rings), but instead a spherical, parabolic, or elliptical curve may trace the actual optimal positions of the tips of the nozzles. An optimal configuration will be affected by the number of nozzles in each ring, the distance between the nozzle rings, the nozzle material (e.g., stainless steel tubes or otherwise), and the geometry of the nozzle housing itself. It should be noted that the nozzle arrangement 270 of FIG. 8 did not exhibit a uniform slope.

Figure 13:
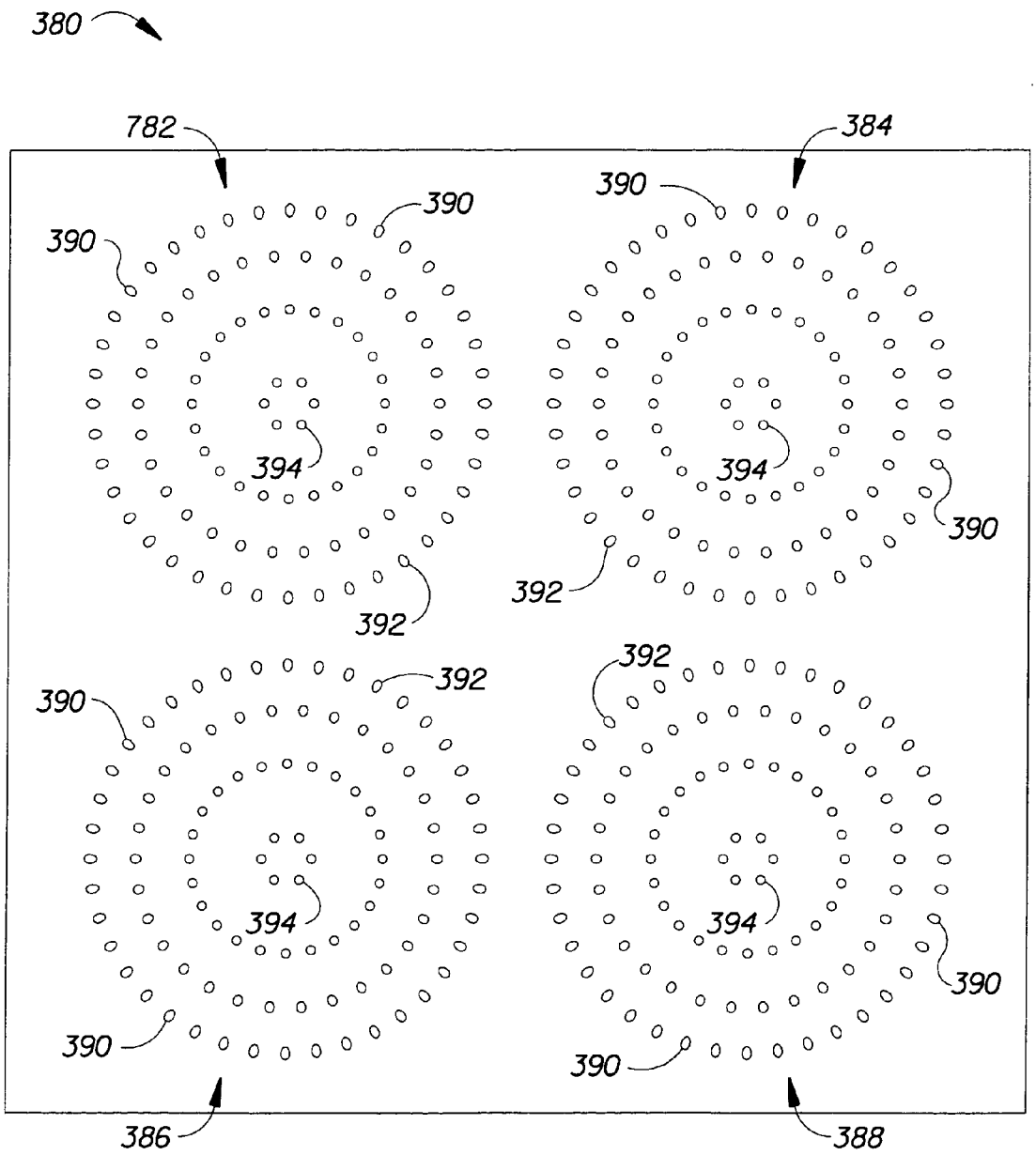
FIG. 13 is a diagrammatic view illustrating the electric field potentials of four sets of multi-port concentric ring nozzles, as seen in a plane in which the nozzles are pointing directly at the viewer.

FIG. 13 illustrates a set of three-ring concentric nozzles, generally designated by the reference numeral 380. In this grouping of nozzles 380, there are four individual three-ring nozzle spray heads at 382, 384, and 386, and 388. The additional nozzle spray heads are used to produce a larger spray pattern and to output a greater flow rate of the spray particles, as desired for a particular installation. FIG. 13 is provided to show the effect of adjacent groups of nozzles, because the electric fields produced by the individual nozzles are affected by the other adjacent nozzle rings. For example, the electric fields of the outermost nozzles in the areas designated by the reference numeral 392 are somewhat reduced in magnitude because they are somewhat proximal to one another. Conversely, the electric fields in the same concentric rings are greater on the outer peripheries, as illustrated at the reference numeral 390, because they are more distal from one another, with respect to the other nozzles in the grouping. This difference in electric fields will be exhibited mainly in the three outer rings, as illustrated in FIG. 13. The innermost rings at 394 will not see much of this effect, mainly because the innermost rings are the most protected from outside influences, and also because the innermost rings have nozzles that are spaced apart the farthest from their own other concentric rings for each particular nozzle body or spray head.

It should be noted that the lengths of all nozzles (or nozzle tubes) in a particular ring need not always be of the same length (or distance from a target), although the above examples have been described as using a uniform length within a particular ring. If certain nozzles within a single ring are allowed to vary in length, then an even greater control over the electric fields being generated could be accomplished, which could be of significant use in some applications. One such application could be in the situation illustrated in FIG. 13, in which the neighboring nozzle groups have an effect upon each other's electric fields, especially in the outermost rings. Certainly the electric field effects could be more closely controlled by fine-tuning the individual lengths of the nozzles in the outermost ring of nozzles (as well as in some of the interior rings, if desired), and thereby fine tune the physical distances between the nozzle tips and a grounded target, especially if the target exhibits a planar upper surface.

As noted above, in many applications using the present invention, the sprayed liquid droplets will be directed into a space or volume where "dirty" air is directed, such that the spray droplets will accumulate dust and other particles or particulates. The individual droplets will then continue to a collecting surface or collecting plate, that is typically at ground potential. This type of design has been described as an overall air cleaning apparatus in earlier patent applications by the same inventors, which are commonly assigned to The Procter & Gamble Company. Examples of these earlier patent applications are: U.S. patent application Ser. No. 10/282,586, filed on Oct. 29, 2002, titled DYNAMIC ELECTROSTATIC FILTER APPARATUS FOR PURIFYING AIR USING ELECTRICALLY CHARGED LIQUID DROPLETS; and U.S. provisional patent application Ser. No. 60/422,345, filed on Oct. 30, 2002, titled DYNAMIC ELECTROSTATIC AEROSOL COLLECTION APPARATUS FOR COLLECTING AND SAMPLING AIRBORNE PARTICULATE MATTER.

It will be understood that the design of the present invention will work well at voltage ranges other than discussed above, including higher voltage ranges, which may even be preferable for certain types of liquids being used to create the charged droplets, and also at increased flow rates if desired for certain applications. It will also be understood that the internal electrodes for all embodiments could be made from virtually any electrically conductive material, or perhaps from certain semiconductive materials.

In many applications involving the spray nozzles of the present invention, there will be a chamber (i.e., some type of predetermined volume) that receives the spray droplets that are emitted by the nozzles. In general, this chamber will include a target surface against which these spray droplets will impact. In situations where the overall spraying apparatus acts as an air cleaner (e.g., by removing particulates from a stream of gas flowing through the chamber), the target surface typically will be such that the spray droplets will aggregate into a liquid, either directly on the target surface itself, or the droplets will be directed (via gravity, for example) toward a separate collecting member of the overall spraying apparatus. While such a target will most likely comprise a solid surface, there may be applications where a solid target surface is not desired. In that circumstance, such target surface could then consist of a mesh or a screen member, or if desired, it could appear solid but exhibit a high porosity characteristic. The effects on the electric field profile of using a mesh or screen for the target surface would need to be evaluated, for a particular installation.

It will be understood that the above target surface could be either charged to a predetermined voltage, or could be effectively held to ground potential. For safety reasons, it might be better to tie the target surface directly to ground, via a grounding strap or a ground plane, for example. However, in some circumstances, perhaps an improved spraying pattern or an improved collection efficiency may be obtained by applying a voltage to this target surface. In many cases, such an applied potential would be at a lower absolute magnitude than the voltage (in absolute magnitude) applied to the internal electrode, but this is not always a necessary restriction.

In some cases, the potential applied to the target surface may well be at the opposite polarity to the voltage applied to the spray droplet (internal) charging electrode. In this circumstance, the charged spray droplets would thereby become directly attracted (via electrostatic charge) to the charged target surface, which may increase collection efficiency of the spray fluid. It will be understood, however, that for air cleaners, a more important attribute will typically be the collection efficiency of the particles in the air stream, and the voltage potential (grounded or not) of the target surface could impact that characteristic. The physical configuration of one possible spraying apparatus of the present invention can be quite different compared to another configuration (including air flow rates, charged droplet spraying rates, expected pressure drop through the air cleaner apparatus, air temperature and humidity, etc.), and the optimum voltage potential of the target surface should be evaluated for each such configuration.

As noted above, the fluids used in the present invention may be used for cleaning air, and the overall apparatus that performs that function is sometimes referred to as an electrohydrodynamic air cleaner. An optimized electrohydrodynamic (EHD) spray will mainly consist of uniform droplet sizes with a high charge-to-mass ratio, which is capable of removing other particulate matter from the airflow. It is generally desired to generate a charged cloud of droplets capable of collecting airborne particulate matter, and the some of the important fluid properties for optimizing such particulate collection include the surface tension, conductivity, and dielectric constant. The types of fluids that are suitable for use in the present invention, or in many types of EHD air cleaners, are described in a co-pending patent application by some of the same inventors, which is commonly assigned to The Procter & Gamble Company. This application is U.S. patent application Ser. No. 10/697,229, filed on Oct. 30, 2003, titled Dynamic Electrostatic Aerosol Collection Apparatus For Collecting And Sampling Airborne Particulate Matter, which claims benefit of U.S. Provisional patent application Ser. No. 60/422,345, filed Oct. 30, 2002.

The principles of the present invention are also applicable to another invention by some of the same inventors, which uses both internal and external electrodes in a nozzle apparatus, to charge a spray fluid and to assist in directing the charged spray droplets, respectively. This invention is described in a co-pending patent application, which is commonly assigned to The Procter & Gamble Company. This application is U.S. patent application Ser. No. 10/969,633, filed on Oct. 20, 2004, titled ELECTROSTATIC SPRAY NOZZLE WITH INTERNAL AND EXTERNAL ELECTRODES.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electrostatic nozzle apparatus, comprising:

a nozzle spray head having: a nozzle body, a fluid inlet at a first surface of the nozzle body, a plurality of fluid outlets at a second surface of the nozzle body, said plurality of fluid outlets comprising a plurality of individual nozzle outlet ports, an internal fluid channel between said fluid inlet and fluid outlets, and an electrode that is electrically charged to a predetermined first voltage magnitude, wherein said electrode is positioned proximal to said fluid channel and imparts an electrical charge to at least a portion of a fluid moving through said fluid channel; and a target member that is spaced-apart from said plurality of individual nozzle outlet ports, said target member exhibiting a proximal surface that faces said plurality of individual nozzle outlet ports; wherein:

said plurality of individual nozzle outlet ports extend at predetermined lengths from said second surface of the nozzle body to a plurality of outlet orifices, such that a plurality of predetermined distances are created between said plurality of outlet orifices and said proximal surface of the target member, and said predetermined distances between said proximal surface and the plurality of outlet orifices are not substantially constant, for one of the plurality of individual nozzle outlet ports as compared to at least another one of the plurality of individual nozzle outlet ports, and wherein the predetermined lengths between said second surface and the plurality of outlet orifices exhibit at least one slope, taken along a radial line that extends outward from a central point of said second surface.

2. The electrostatic nozzle apparatus as recited in claim 1, wherein said plurality of individual nozzle outlet ports is arranged in a pattern of at least two concentric circles.

3. The electrostatic nozzle apparatus as recited in claim 2, wherein said nozzle spray head exhibits: (a) a first spacing dimension, taken along a radial line of said second surface, between a first of said at least two concentric circles and a second of said at least two concentric circles, and (b) a second spacing dimension, taken along a radial line of said second surface, between said second of said at least two concentric circles and a third of said at least two concentric circles; and wherein said first spacing dimension is not equal in distance to said second spacing dimension.

4. The electrostatic nozzle apparatus as recited in claim 1, wherein said plurality of individual nozzle outlet ports is arranged in a non-circular pattern.

5. The electrostatic nozzle apparatus as recited in claim 1, wherein said at least one slope is constant along the entire radial line.

6. The electrostatic nozzle apparatus as recited in claim 5, wherein said at least one slope is contoured, and thus not constant along the entire radial line.

7. The electrostatic nozzle apparatus as recited in claim 1, wherein said plurality of individual nozzle outlet ports are sized and positioned in a manner that tends to minimize a gradient in an electric field magnitude between one of said plurality of outlet orifices and another one of said plurality of outlet orifices.

8. The electrostatic nozzle apparatus as recited in claim 1, wherein:

the proximal surface of said target member is substantially planar; and said predetermined lengths from said second surface of the nozzle body to said plurality of outlet orifices are not constant, for one of the plurality of individual nozzle outlet ports as compared to at least another one of the plurality of individual nozzle outlet ports.

9. The electrostatic nozzle apparatus as recited in claim 1, wherein:

the proximal surface of said target member is not substantially planar; and said predetermined lengths from said second surface of the nozzle body to said plurality of outlet orifices are substantially constant, for all of the plurality of individual nozzle outlet ports.

10. An electrostatic nozzle apparatus, comprising:

a nozzle spray head having: a nozzle body, a fluid inlet at a first surface of the nozzle body, a plurality of fluid outlets at a second surface of the nozzle body, said plurality of fluid outlets comprising a plurality of individual nozzle outlet ports that extend at predetermined lengths from said second surface of the nozzle body to one of a plurality of outlet orifices, an internal fluid channel between said fluid inlet and fluid outlets, and an electrode that is electrically charged to a predetermined first voltage magnitude, wherein said electrode is positioned proximal to said fluid channel and imparts an electrical charge to at least a portion of a fluid moving through said fluid channel; and a target member that is spaced-apart from said plurality of individual nozzle outlet ports, said target member exhibiting a proximal surface that faces said plurality of individual nozzle outlet ports;

wherein said plurality of individual nozzle outlet ports are sized and positioned in a manner that tends to minimize a gradient in an electric field magnitude between one of said plurality of outlet orifices and another one of said plurality of outlet orifices, wherein said predetermined lengths between said second surface and each of the plurality of outlet orifices are not substantially constant for one of the plurality of individual nozzle outlet ports as compared to at least another one of the plurality of individual nozzle outlet ports, and wherein the proximal surface of said target member is substantially planar.

11. The electrostatic nozzle apparatus as recited in claim 10, wherein said plurality of individual nozzle outlet ports are sized and positioned so as to exhibit a substantially uniform electric field magnitude at each of the plurality of outlet orifices.

12. The electrostatic nozzle apparatus as recited in claim 10, wherein said predetermined lengths between said second surface and each of the plurality of outlet orifices are substantially constant for all of the plurality of individual nozzle outlet ports.

13. The electrostatic nozzle apparatus as recited in claim 12. wherein the proximal surface of said target member is not substantially planar.

14. The electrostatic nozzle apparatus as recited in claim 10, wherein said plurality of individual nozzle outlet ports is arranged in a pattern of at least two concentric circles.

15. The electrostatic nozzle apparatus as recited in claim 14, wherein said nozzle spray head exhibits: (a) a first spacing dimension, taken along a radial line of said second surface, between a first of said at least two concentric circles and a second of said at least two concentric circles, and (b) a second spacing dimension, taken along a radial line of said second surface, between said second of said at least two concentric circles and a third of said at least two concentric circles; and wherein said first spacing dimension is not equal in distance to said second spacing dimension.

16. The electrostatic nozzle apparatus as recited in claim 14, wherein said nozzle spray head exhibits: (a) a first spacing dimension, taken along a radial line of said second surface, between a first of said at least two concentric circles and a second of said at least two concentric circles, and (b) a second spacing dimension, taken along a radial line of said second surface, between said second of said at least two concentric circles and a third of said at least two concentric circles; and wherein said first spacing dimension is equal in distance to said second spacing dimension.

17. The electrostatic nozzle apparatus as recited in claim 10, wherein said predetermined lengths between said second surface and each of the plurality of outlet orifices are substantially constant for all of the plurality of individual nozzle outlet ports; and wherein a first group of said plurality of individual nozzle outlet ports is charged to a first voltage magnitude, while a second group of said plurality of individual nozzle outlet ports is charged to a second voltage magnitude that is different from said first voltage magnitude.

18. An electrostatic nozzle apparatus, comprising:

a nozzle spray head having: a nozzle body, a fluid inlet at a first surface of the nozzle body, a plurality of fluid outlets at a second surface of the nozzle body, said plurality of fluid outlets comprising a plurality of individual nozzle outlet ports, an internal fluid channel between said fluid inlet and fluid outlets, and an electrode that is electrically charged to a predetermined first voltage magnitude, wherein said electrode is positioned proximal to said fluid channel and imparts an electrical charge to at least a portion of a fluid moving through said fluid channel;

wherein said nozzle spray head exhibits: (a) a first spacing dimension, taken along a radial line of said second surface, between a first of said at least two concentric circles and a second of said at least two concentric circles, and (b) a second spacing dimension, taken along a radial line of said second surface, between said second of said at least two concentric circles and a third of said at least two concentric circles; and wherein said first spacing dimension is not equal in distance to said second spacing dimension; and a target member that is spaced-apart from said plurality of individual nozzle outlet ports, said target member exhibiting a proximal surface that faces said plurality of individual nozzle outlet ports, wherein said plurality of individual nozzle outlet ports extend at predetermined lengths from said second surface of the nozzle body to a plurality of outlet orifices, such that a plurality of predetermined distances are created between said plurality of outlet orifices and said proximal surface of the target member, wherein said plurality of individual nozzle outlet ports is arranged in a pattern of at least two concentric circles; and said predetermined distances between said proximal surface and the plurality of outlet orifices are not substantially constant, for one of the plurality of individual nozzle outlet ports as compared to at least another one of the plurality of individual nozzle outlet ports.

19. An electrostatic nozzle apparatus, comprising:

a nozzle spray head having: a nozzle body, a fluid inlet at a first surface of the nozzle body, a plurality of fluid outlets at a second surface of the nozzle body, said plurality of fluid outlets comprising a plurality of individual nozzle outlet ports, an internal fluid channel between said fluid inlet and fluid outlets, and an electrode that is electrically charged to a predetermined first voltage magnitude, wherein said electrode is positioned proximal to said fluid channel and imparts an electrical charge to at least a portion of a fluid moving through said fluid channel; and a target member that is spaced-apart from said plurality of individual nozzle outlet ports, said target member exhibiting a proximal surface that faces said plurality of individual nozzle outlet ports; wherein:

said plurality of individual nozzle outlet ports extend at predetermined lengths from said second surface of the nozzle body to a plurality of outlet orifices, such that a plurality of predetermined distances are created between said plurality of outlet orifices and said proximal surface of the target member, and said predetermined distances between said proximal surface and the plurality of outlet orifices are not substantially constant, for one of the plurality of individual nozzle outlet ports as compared to at least another one of the plurality of individual nozzle outlet ports, and wherein the proximal surface of said target member is substantially planar; and said predetermined lengths from said second surface of the nozzle body to said plurality of outlet orifices are not constant, for one of the plurality of individual nozzle outlet ports as compared to at least another one of the plurality of individual nozzle outlet ports.

20. An electrostatic nozzle apparatus, comprising:

a nozzle spray head having: a nozzle body, a fluid inlet at a first surface of the nozzle body, a plurality of fluid outlets at a second surface of the nozzle body, said plurality of fluid outlets comprising a plurality of individual nozzle outlet ports that extend at predetermined lengths from said second surface of the nozzle body to one of a plurality of outlet orifices, an internal fluid channel between said fluid inlet and fluid outlets, and an electrode that is electrically charged to a predetermined first voltage magnitude, wherein said electrode is positioned proximal to said fluid channel and imparts an electrical charge to at least a portion of a fluid moving through said fluid channel; and a target member that is spaced-apart from said plurality of individual nozzle outlet ports, said target member exhibiting a proximal surface that faces said plurality of individual nozzle outlet ports;

wherein said plurality of individual nozzle outlet ports are sized and positioned in a manner that tends to minimize a gradient in an electric field magnitude between one of said plurality of outlet orifices and another one of said plurality of outlet orifices, wherein said plurality of individual nozzle outlet ports is arranged in a pattern of at least two concentric circles, and wherein said nozzle spray head exhibits: (a) a first spacing dimension, taken along a radial line of said second surface, between a first of said at least two concentric circles and a second of said at least two concentric circles, and (b) a second spacing dimension, taken along a radial line of said second surface, between said second of said at least two concentric circles and a third of said at least two concentric circles; and wherein said first spacing dimension is not equal in distance to said second spacing dimension.

* * * * *

UNITED STATES PATENT AND TRADEMARK OFFICE

CERTIFICATE OF CORRECTION

PATENT NO. : 7,160,391 B2
APPLICATION NO. : 10/969668
DATED : October 20, 2004
INVENTOR(S) : Alan David Willey et al.

It is certified that error appears in the above-identified patent and that said Letters Patent is hereby corrected as shown below:

Column 18
Line 29, delete "14" and insert -- 15 --.
Line 40, delete "10" and insert -- 11 --.

Signed and Sealed this

First Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,160,391 B2
APPLICATION NO. : 10/969668
DATED : January 9, 2007
INVENTOR(S) : Alan David Willey et al.

It is certified that error appears in the above-identified patent and that said Letters Patent is hereby corrected as shown below:

Column 18
Line 29, delete "14" and insert -- 15 --.
Line 40, delete "10" and insert -- 11 --.

This certificate supersedes the Certificate of Correction issued April 1, 2008.

Signed and Sealed this

Sixth Day of May, 2008

JON W. DUDAS
*Director of the United States Patent and Trademark Office*